United States Patent [19]

Sodec et al.

[11] Patent Number: 5,069,114

[45] Date of Patent: Dec. 3, 1991

[54] DEVICE FOR INTRODUCING A LOW TURBULENCE DISPLACEMENT AIR FLOW INTO AN ENCLOSED SPACE

[75] Inventors: Franc Sodec, Wuerselen-Broichweiden; Werner Veldboer, Stolberg, both of Fed. Rep. of Germany

[73] Assignee: H. Krantz GmbH & Co., Aachen, Fed. Rep. of Germany

[21] Appl. No.: 600,518

[22] Filed: Oct. 19, 1990

[30] Foreign Application Priority Data

Oct. 26, 1989 [DE] Fed. Rep. of Germany ..... 3935620

[51] Int. Cl.[5] ..... F24F 13/06

[52] U.S. Cl. ..... 454/297; 454/298

[58] Field of Search ..... 98/40.01, 40.05, 40.1, 98/40.11, 41.2, 115.2

[56] References Cited

FOREIGN PATENT DOCUMENTS

| | | | |
|---|---|---|---|
| 2033195 | 1/1972 | Fed. Rep. of Germany | 98/40.1 |
| 3435602 | 7/1986 | Fed. Rep. of Germany | 98/40.01 |
| 3643175 | 6/1988 | Fed. Rep. of Germany | 98/40.1 |
| 89947 | 5/1984 | Japan | 98/40.1 |
| 1446427 | 12/1988 | U.S.S.R. | 98/40.11 |
| 2120778 | 12/1983 | United Kingdom | 98/40.1 |

*Primary Examiner*—Harold Joyce
*Attorney, Agent, or Firm*—W. G. Fasse

[57] ABSTRACT

A device for introducing a low turbulence air displacement flow into an enclosed space, has a first housing section enclosing an air distribution space having an air inlet on one side and air flow passages through another side, and a second housing section having a perforated outer jacket and a non-perforated central core pipe. One central air flow passage connects the core pipe to the air distribution space. A ring of holes or a ring gap leads into a ring space formed between the perforated jacket and the core pipe. A third air passage permits forming an air skirt around the outer surface of the jacket. Control elements permit selectively opening and closing the flow passages, so that all or part of the fresh air may pass through the core pipe and air skirt or through the ring space. The perforated jacket may have a cylindrical portion and a frustum portion connecting the cylindrical portion to a perforated bottom plate. Air exiting through the air skirt and through the core pipe entrains air exiting through the perforated jacket to form the displacement air flow.

20 Claims, 5 Drawing Sheets

DEVICE FOR INTRODUCING A LOW TURBULENCE DISPLACEMENT AIR FLOW INTO AN ENCLOSED SPACE

FIELD OF THE INVENTION

The invention relates to an apparatus for introducing a low turbulence displacement airflow into an enclosed space, such as a manufacturing hall. The device has an air distributor enclosing a distribution space connected through an air inlet connector to an air supply conduit. The bottom of the distributor is with air outlet openings.

BACKGROUND INFORMATION

An air introducing device as described above is disclosed in German Patent Publication (DE) 3,643,175. The known device comprises a distribution space having air outlet openings formed by holes in an apertured bottom of the distribution space. These outlet openings lead into a chamber arranged below the distribution space. The chamber has a bottom with air nozzles functioning as outlet openings. The on-center spacing between the air nozzles is at least three times the nozzle exit diameter but may be as large as twelve times the exit diameter. The individual air jets produceable by the known device are not completely free of air turbulences, however, the produced air jets make it possible to generate a stable displacement flow having a relatively small displacement flow.

Thus, the known device has the substantial disadvantage that it is not suitable for producing a sufficiently stable, low turbulence displacement flow in rooms or enclosed spaces having high ceilings. Sheds or halls used for coating aircrafts with outer protective skins, such as lacquer skins, require the introduction of fresh air at substantial heights. The air inlets for introducing the fresh air are located in the shed ceiling which may be as high as 20 to 25 meters. Used air is sucked out through air outlets in the floor leading into air exhaust channels in the floor for the exhaust of the used air. Thus, the air flow in such sheds is vertically downwardly from the ceiling to the floor. For keeping such sheds sufficiently ventilated it is necessary to remove solvent vapors, lacquer aerosols, and the like, with an air flow that is as low as possible in turbulence so that these air contaminants are displaced on a direct path toward the air exhaust channels. Therefore, the fresh air flow must be low in turbulence. A low turbulence air flow is also necessary for avoiding or at least minimizing an all too extensive intermixing of these contaminants with the air in the shed. Additionally, the time during which the contaminants are present, should also be as short as possible, because high concentrations of lacquer aerosols and solvents in the breathing air adversely affect the health of personnel present in such facilities and the quality of the surfaces that are to be lacquer coated.

The lacquer coating operation is followed by a drying of the sprayed-on lacquer. The spraying is performed at a temperature within the range of about 20° to 22° C., whereby the fresh air is blown in isothermally more or less or slightly under-cooled. However, the drying is performed while the temperature of the fresh air inflow is increased to accelerate the drying process. Thus, the fresh air inflow has a temperature higher than the room temperature. The same operating conditions also prevail already during the lacquer spraying operation when the outdoor temperature is lower than the temperature in the shed so that heat losses by heat transmission must be covered by heat introduced with the fresh air.

Thus, for achieving a stable displacement flow it is necessary that the jet impulse is variable in response to the difference in the room temperature of the shed and the fresh air temperature. In case heating is required, the fresh air temperature is higher than the room temperature. Therefore the air exit impulse of the fresh air jets must be higher than in the cooling case at which time the room temperature is higher than the fresh air being introduced into the shed.

Furthermore, it is necessary to adapt the jet impulse of the fresh air to the particular type of aircraft that is to be coated. This is so, because aircraft with a larger body height are exposed to the fresh air flow more intensely than aircraft having a smaller body height. This is primarily due to the fact that the air blowout plane of the fresh air inlets is located closer to a tall aircraft body than to a smaller aircraft body.

OBJECTS OF THE INVENTION

In view of the above it is the aim of the invention to achieve the following objects singly or in combination:

to provide a device for introducing a low turbulence air displacement flow into an enclosed space, especially manufacturing halls having high ceilings, such as aircraft manufacturing halls;

to satisfy the specific air displacement and air replacement requirements for manufacturing facilities, especially where air contaminants must be removed and replaced by fresh air;

to provide a device for introducing large air volumes into an enclosed space;

to provide a fresh air inflow control that permits adjusting the penetration depth or reach of the fresh air down from a high ceiling into an enclosed space;

to assure that the low turbulent fresh air inflow is produced and maintained in a stable condition;

to provide means for controlling and modifying the jet or flow impulse; and to construct a fresh air inlet that is able to admit large air volumes into an enclosed space.

SUMMARY OF THE INVENTION

The device for introducing a low turbulence displacement air flow into an enclosed space comprises, according to the invention, the following features. A housing has an air inlet connectable to a fresh air supply duct, which is preferably arranged in a vertical orientation. The housing has a first housing section with a first wall through which said air inlet extends and with an air outlet opening arranged coaxially with said air inlet. The housing has a second section connected to or integral with the first housing section and forming a central core pipe concentrically surrounded by a perforated housing jacket of the second housing section. One end of the core pipe forms said air outlet opening between the first and second housing sections. A valve disk, controllable in its position can open or close the air outlet opening. A ring space is enclosed between the core pipe and the perforated housing jacket. Air passage means are arranged circularly around the air outlet opening between the first and second housing section. The air passage means may be a ring of holes or a ring air passage. These air passage means lead from inside said first housing section into the ring space between the core pipe and the perforated housing jacket of the second housing section. The core pipe is not perforated. The first housing section has a larger diameter than the second housing section, so that the first housing section extends radially outside the perforated jacket of the second housing section with a ring bottom portion of the first housing section. The ring bottom portion has at least one further closable air outlet opening. A closure member for the further air outlet opening controls an air flow out of said further air air outlet opening to form an air jet skirt which envelopes the perforated jacket of the second housing section.

The present device provides a first air flow through the core pipe, a second air flow through the ring space, and a third air flow forming said air skirt. Depending on the desired proportion of the first and third air flows relative to the total volume of fresh air to be introduced through the device, a respective air volume proportion is guided perpendicularly downwardly thereby entraining the other air volume proportion passing through the ring space and the respective air openings and perforations. This air entraining increases or extends the penetration depth or reach of the entire fresh air volume. It is suggested to select the vertically downwardly directed air flow volume of the first and second air flows to be large relative to the total fresh air volume if the fresh air has a temperature higher than the temperature of the air in the enclosed space. The arrangement is such that air flow into the ring space surrounded by the perforated jacket is interrupted when or if the core pipe is completely open and if the, preferably ring gap shaped, further air outlet forms the air jet skirt. In that case the entire fresh air input through the device flows through the core pipe vertically downwardly and through the ring gap vertically downwardly. This position of the valve disk and of the closure members forming air flow control elements is selected especially or primarily if the enclosed space is to be heated or when such space is to be quickly scavenged with fresh air.

If the core pipe is completely open, the entire fresh air input flows through the ring space and out through the perforations with a low flow velocity. This position of the air flow control elements is preferably used when the enclosed space is to be cooled, since in that case the fresh air with its lower temperature has a downflow tendency anyway. In this state of the device, the fresh air is blown out partially vertically downwardly, partly at a slant, and partly horizontally.

According to another embodiment of the invention the closure member for the further air outlet, preferably in the form of a ring gap that forms the air jet skirt, is closable by a ring disk which is coupled with the valve disk for closing the core pipe. Thus, the ring disk and the valve disk are operable in synchronism with each other to be adjustable in an axial direction within an air distribution space formed by the first housing section.

According to a further embodiment of the invention the above mentioned air passage means in the form of a ring of holes or a ring air passage around the air outlet opening leading into the core pipe, is closable by a ring washer. This ring washer is also coupled to the valve disk for movement in synchronism with the valve disk and the ring disk. Additionally, the ring washer is guided within a ring space to permit an axial position adjustment.

The just described features of the invention are so arranged that an axial stroke motion of the valve disk either progressively closes said further air outlet that forms the air skirt, while the flow passages leading into the ring space between the core pipe and the perforated jacket, are being progressively opened, or vice versa.

According to another embodiment of the invention the perforated jacket surrounding the ring space, has a perforated cylindrical jacket section and the bottom of the ring space including the downwardly facing end of the core pipe are closed by a perforated circular bottom plate which has a diameter smaller than the perforated cylindrical jacket section. A frustum shaped perforated jacket section connects the bottom plate with the cylindrical jacket section. This type of construction provides an open fan type, low turbulence air flow of the fresh air jets.

In order to assure that the fresh air volume enters the ring space uniformly, another embodiment of the invention arranges an air distribution ring with a spacing just below the air passage or air passages into the ring space.

Another embodiment of the invention arranges a perforated air distribution plate in the first housing section forming the air distribution space. The air distribution plate is positioned in parallel to and with a spacing just below the air inlet of the first housing section to make sure that the entering fresh air volume enters uniformly into the air distribution space. Preferably, the air distribution plate has a diameter larger than the fresh air inlet, so that the entire fresh air volume entering the air distribution space is divided into individual air jets by the perforated air distribution plate.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
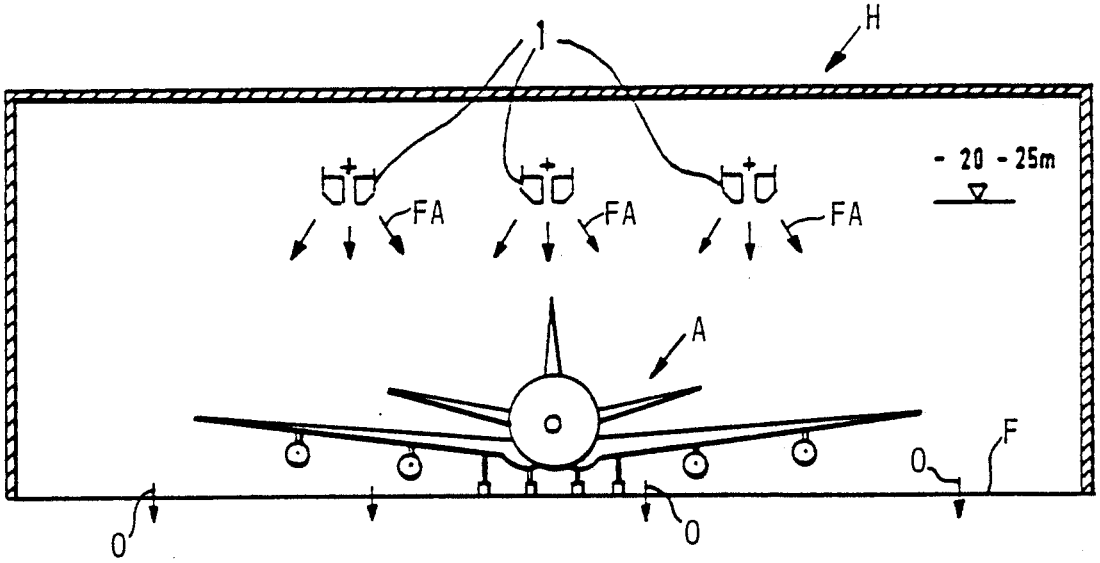
FIG. 1 is a schematic vertical section through an aircraft lacquering hall wherein, for example, three air introducing devices of the invention, are arranged below the ceiling at a level of about 20 to 25 meters above the floor.

FIG. 1 shows an aircraft A parked in a lacquering hall H having a floor F with used air outlets shown by arrows O. Three fresh air introducing devices 1 are schematically shown at a level of about 20 to 25 meters above floor level. The incoming fresh air is shown as arrows FA illustrating how the fresh air is fanned out to uniformly fill the hall H with an air flow that is low in turbulence for displacing used air out through the outlets O. Each device 1 is a member of a row of such devices, whereby each row extends perpendicularly to the plane of the drawing sheet. The number of devices in each row will depend on the size of the particular hall space requirements. In any event, the length of each row will have a length sufficient to completely envelope the particular item, such as an aircraft A, with fresh air forming an air displacement flow for displacing used air out of the hall H.

Figure 2:
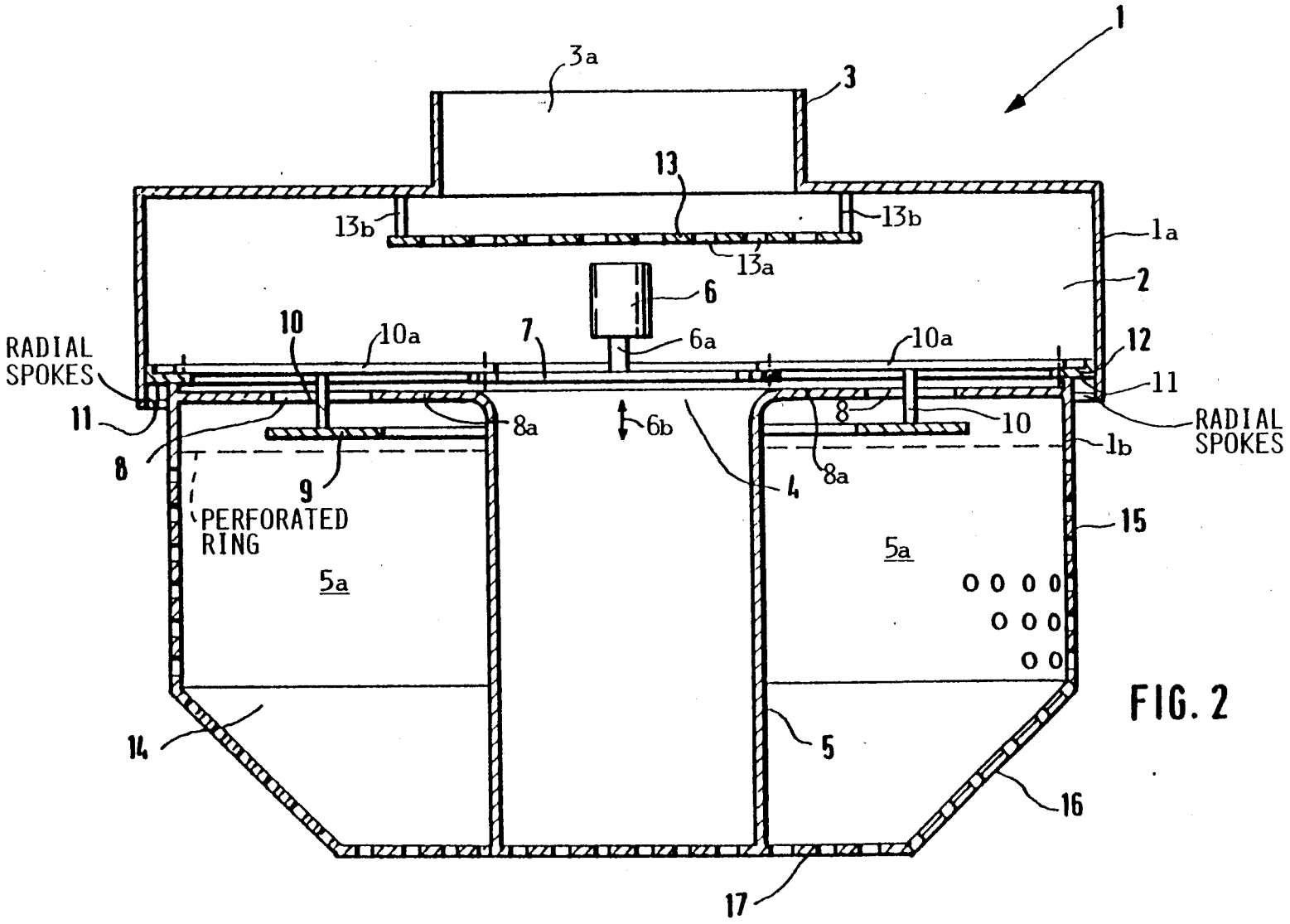
FIG. 2 is an axial, vertical sectional view through an air introducing device according to the invention, for use, for example, in an aircraft lacquering hall as shown in FIG. 1, whereby the air inlet passages into the ring space are shown in an open condition while the air inlet into the core pipe and the air outlet for forming the air skirt are shown in their closed condition.
Figure 3:
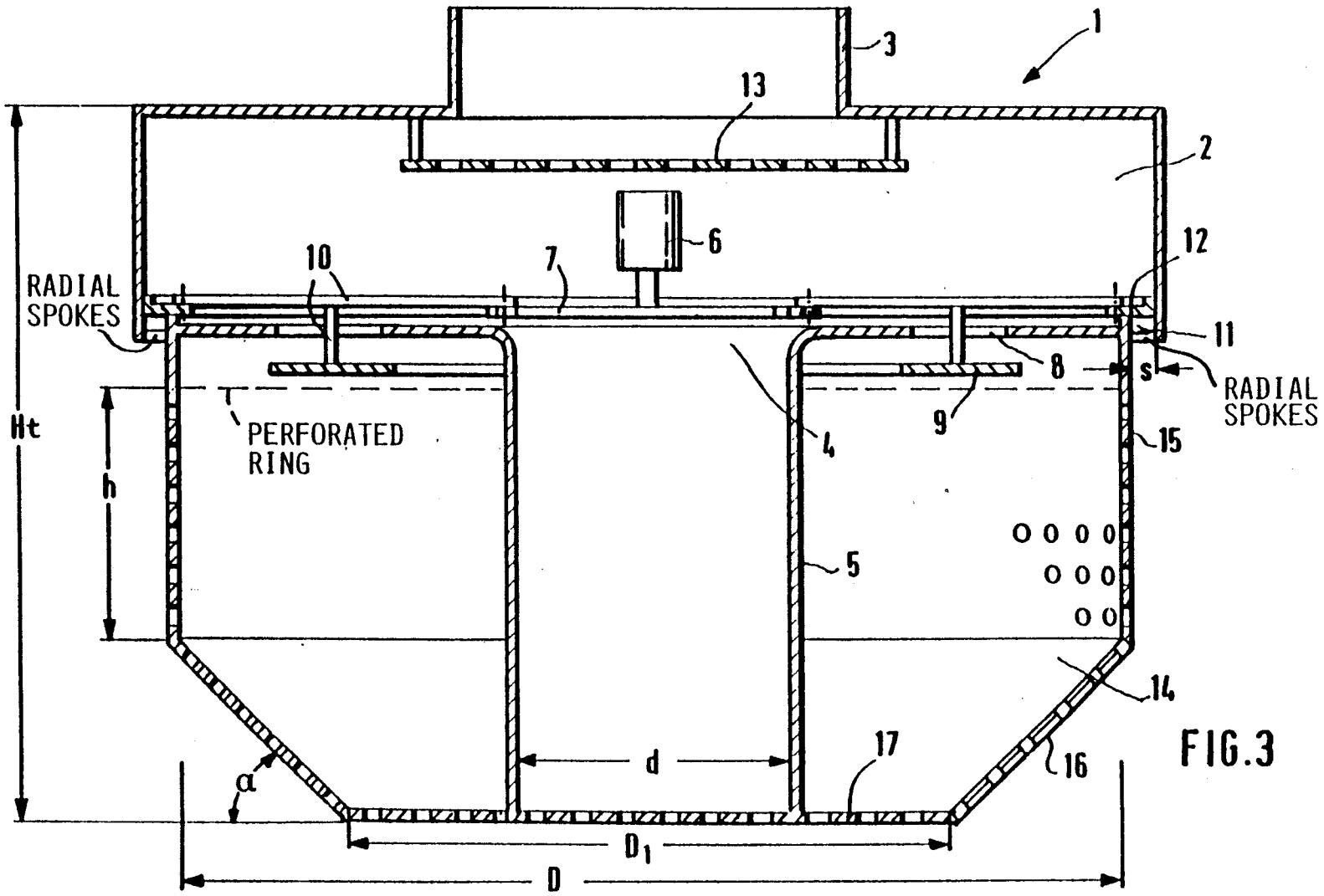
FIG. 3 is a view as in FIG. 2, but provided with dimensional information for the device and angular information for the perforated jacket section forming the frustum shaped lower jacket portion.
Figure 4:
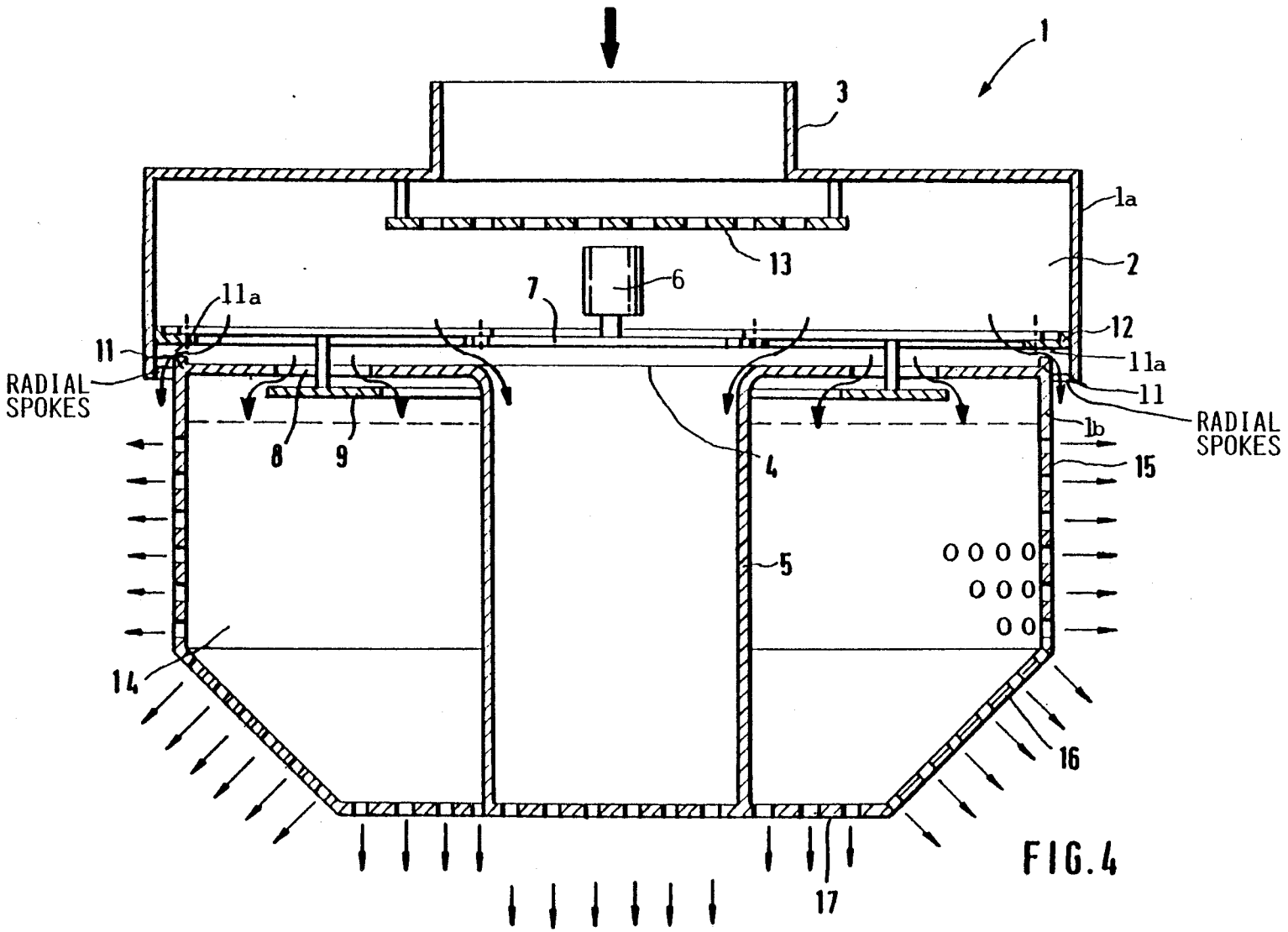
FIG. 4 shows another view similar to FIGS. 1 and 2 but with all air outlet passages shown in a partly open condition.

As shown in FIGS. 2, 3, and 4, each of the devices 1 comprises a first housing section 1*a* and a second housing section 1*b*. These housing sections 1*a* and 1*b* preferably have a circular cross-section. The first housing section encloses an air distribution space 2 connected through an air inlet opening 3*a* to a fresh air duct not shown, but connectable to an air inlet 3. A perforated air distribution plate 13 is arranged with a spacing below the inlet opening 3*a* in a fixed or adjustable position. As shown the plate 13 with its perforations 13*a* is secured to the top of the housing section la by brackets 13*b*. Preferably, the plate 13 has a diameter larger than the diameter of the air inlet opening 3*a* to provide a uniform air flow into the distribution space 2. The plate 13 is arranged concentrically with a central axis of the device 1 and thus concentrically with the fresh air inlet opening 3*a* leading concentrically into the space 2.

The downwardly facing side of the housing section 1*a* has an air outlet opening 4 also arranged concentrically with the central axis of the space 2 and of the air inlet opening 3*a*. The air outlet opening 4 of the housing section 1*a* preferably has a diameter corresponding at least approximately to the diameter of an upper end opening of a core pipe 5 arranged concentrically in the second housing section 1*b*. The core pipe 5 is aligned coaxially with the air inlet 3 and extends downwardly from the housing section 1*a*. The wall of the core pipe 5 is not perforated. A valve disk 7 carried by an axially movable drive rod 6*a* operable by a drive motor 6, is arranged to open and close the air outlet opening into the core pipe 5. The drive motor can hold the valve disk 7 in any desired position relative to the opening 4 for the desired air flow control by fully or partly closing the opening 4.

The top 8*a* of the housing section 1*b* is provided with air passage means 8 arranged radially outwardly concentrically around the air outlet opening 4. The air passage means 8 may comprise a ring of holes or a ring air passage in the top 8*a*. A ring disk 9 is coupled to the valve disk 7 by coupling elements 10, 10*a*, whereby the coupling elements 10 extend in parallel to the central axis of the device 1, while the coupling elements 10*a* extend preferably radially to connect, as spokes, the valve disk 7 to a ring disk 12 movable in a peripheral zone of the bottom of the housing section 1*a*. Thus, the ring disks 9 and 12 is also operable by the drive motor 6 for opening and closing the air passage means 8. The valve disk 7 is arranged inside the air distribution space 2 above the top 8*a* of the housing section 1*b*, while the ring disk 9 is arranged below the top 8*a* inside a ring space 5*a* between the core pipe 5 and a perforated first jacket portion 15 of the second housing section 1*b*. Due to this arrangement an opening motion for the valve disk 7 is a closing motion for the ring disk 9 and vice versa, whereby the same drive motor 6, such as an electromagnetic drive can be used for operating all disks 7, 9 and 12.

The above mentioned ring disk 12 in the peripheral bottom zone of the housing section la forms a rim connected to the valve disk 7 forming a hub, by the spoke type coupling elements 10*a*, whereby the ring disk 12 is also operable in unison or synchronism with the disks 7 and 9 by the drive motor 6. When the ring disk 12 rests on the upper edge 11 of the second housing section 1*b* a further air outlet opening 11*a* forming a ring gap, best seen in FIG. 4, is closed as shown in FIGS. 2 and 3. When the ring disk 12 is lifted off the upper edge 11 the opening 11*a* or ring gap is open as shown in FIG. 3. For forming the ring gap 11*a*, the upper housing section 1*a* has an inner diameter larger than the outer diameter of the lower housing section 1*b* and the ring disk 12 is so dimensioned that it can rest on the upper edge 11. As mentioned, due to the coupling of the ring disk 12 with the valve disk 7 and the ring disk 9, these elements are operated in unison. However, the valve disk 7 and the ring disk 12 are opened or closed together or in synchronism with each other, while the ring disk 9 closes or opens respectively, except when the valve disk 7 and the ring disk 12 are in an intermediate position. In that case the ring disk 9 is also in an intermediate position.

The housing section 1*b* has, in addition to the perforated, cylindrical jacket portion 15 surrounding the ring space 5*a*, a further perforated jacket portion 16 having a frustum shape and enclosing a respective ring space 14 between the core pipe 5 and the frustum jacket portion 16. Air entry from the distribution space 2 into the ring spaces 5*a* and 14 depends on the position of the ring disk 9 which determines the air passage out of the distribution space 2 into the ring spaces 5*a* and 14. The bottom of the perforated frustum portion 16 is formed by a bottom plate 17 which is also perforated and forms a perforated bottom for the core pipe 5. The top 8*a* may be a flange of the core pipe 5.

Due to the above mentioned larger inner diameter of the first housing section 1*a*, the first housing section 1*a* extends radially outwardly of the second housing section 1*b*, so that the further air outlet opening 11 opens outside of the jacket portion 15, thereby forming an air jet skirt axially downwardly along the outside of the jacket portion 15. The air volume forming the air jet skirt and the air volume passing through the core pipe 5 thus bypass the ring spaces 5*a* and 14. Depending on the size and impulse of these bypassing air volumes, the air jets passing through the apertures in the jacket portions 15, 16 are guided with more or less intensity vertically downwardly into the space of the hall H to be supplied with fresh air, whereby an altogether low turbulence air displacement flow is produced.

Referring to FIG. 3, it is suggested that in halls H having a useful ceiling height of more than 20 meters, the devices 1 to be installed should have an outer diameter D for the jacket portion 15 in the range of 1.0 to 2.0 meters. The total height Ht of both housing sections, disregarding their axial overlapping, should be within the range of 1.0 to 1.5 meters. The inner diameter d of the core pipe 5 should be 0.1 to 0.4 times the outer diameter D of the cylindrical jacket. The axial height h of the cylindrical jacket portion 15 or rather of the ring space 14 should be 0.15 to 0.25 times the outer diameter D. The perforated bottom 17 of the second housing section 1*b* should have a diameter D1 corresponding to 0.6 to 0.7 times said outer diameter D of the cylindrical jacket section 15. The radial width of the gap between the inner wall of the first housing section 1*a* and the outer wall of the second housing section 1*b* should correspond to 0.02 to 0.04 times the outer diameter D. The angle $\alpha$ between the horizontal and the inclination of the jacket portion 16 should be within the range of about 40° to 50°.

Figure 5A:
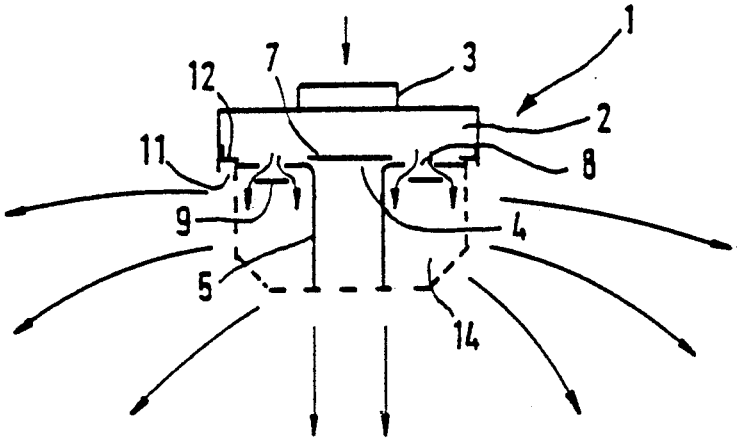
FIG. 5*a* is a schematic view showing the opening state of the air passages and outlet openings for introducing fresh air which is colder than the temperature of the air in the space into which the fresh air is being introduced.

As shown in FIG. 5*g* the entire fresh air volume passes through air passage means 8 and through the ring spaces 5*a* and 14 if the outlet opening 4 and the further ring outlet 11 are closed. This air volume then passes out through the perforations in elements 15, 16, whereby a low turbulence air flow is produced which has a fanned out configuration and a low exit impulse. The positions of the flow control means 7, 9, and 12 shown in FIG. 5*a* is used for introducing fresh air into the hall H if the temperature of the fresh air is lower than the temperature of the used air in the space enclosed by the hall H.

Figure 5B:
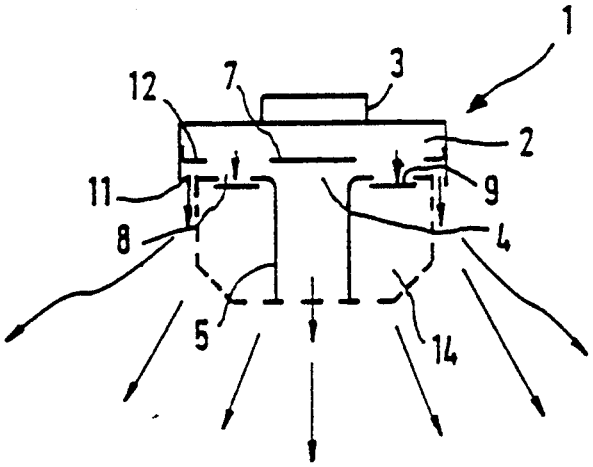
FIG. 5*b* is a view similar to that of FIG. 5*a*, but showing the opening condition of the air passages and outlet openings for introducing fresh air having a temperature which is the same as that of the air in the enclosed space.

FIG. 5*b* shows positions of the air flow control means 7, 9, 12 used for introducing fresh air if the temperature of the fresh air is not substantially different from the temperature of the used air, in other words, if these temperatures are substantially the same. In this instance, the outlet openings 4 and 11 are partially opened, so that a volume portion of the fresh air forms an air jet skirt around the jacket portion 15 and another volume portion passes through the core pipe 5, thereby forming a supporting air jet having a higher air flow speed than in FIG. 5*a*, whereby a large surface area air flow is induced or entrained out of the ring spaces 5*a*, 14. This feature increases the penetration depth or reach of the fresh air into the enclosed space, since the fresh air is fanned out to a lesser degree than with the flow control positions shown in FIG. 5*a*.

Figure 5C:
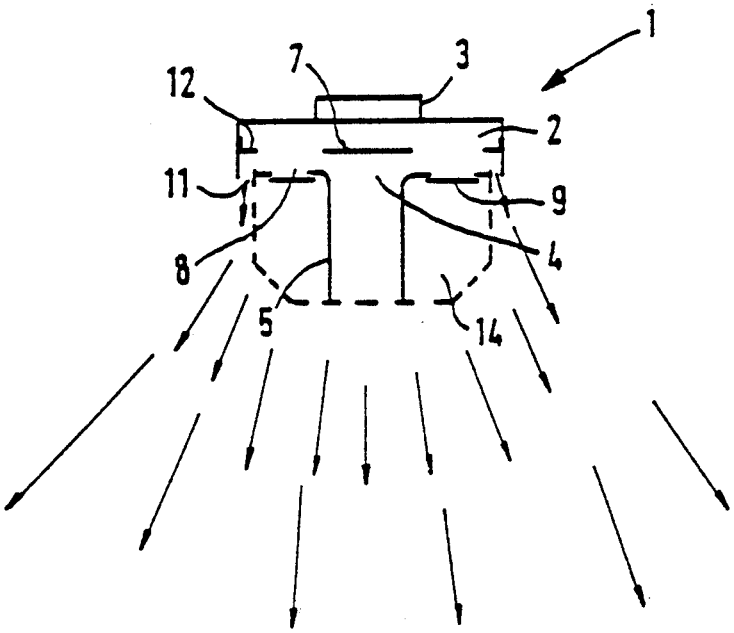
FIG. 5*c* is a view similar to that of FIGS. 5*a* and 5*b*, but showing the opening condition when the fresh air being introduced is warmer than the air in the enclosed space.

FIG. 5*c* shows control positions of the flow control means 7, 9, 12 used when the temperature of the fresh air is warmer than the room temperature. Compared to FIG. 5*b*, the valve disk 7 and the ring washer 12 are spaced from their respective cooperating elements to a larger extent than in FIG. 5*b*, whereby the supporting air jet is further amplified, the output impulse is increased, and the reach or penetration depth is lengthened.

The blowing-out speed of the air jets exiting through the apertures in the perforated housing jacket 15, 16 is within the range of 0.3 to 1.0 m/s for minimizing the induction of room air. However, the exiting speed of the supporting air jet coming out of core pipe 5 through the apertures in the central portion of the apertured bottom 17, is adjustable within the range of 0.0 to 20.0 m/s. The higher the blowing-out or exiting speed, the larger the induction of room air into the fresh air flow. However, since the core pipe is arranged centrally in the air exit zone and since the air skirt formed by air blowing out of the further ring opening 11, flows substantially in contact with the cylindrical jacket 15 of the ring space 5*a*, the support air jet out of the core pipe 5 does not induce room air. Rather, support air jets coming out of the apertures in the central portion of the bottom 17, that is, out of the core pipe 5, entrain primarily or predominantly the neighboring air jets coming out of the apertures of the perforated jackets 15, 16.

The perforated jackets 15, 16 further have the advantage, that the air jets exiting through the aperatures in these jackets 15, 16 have a low turbulence characteristic. The turbulence is the smaller the smaller the diameter of the apertures or holes in the jackets 15 16.

The invention combines two important advantages, namely a low turbulent displacement air flow and a very low induction of room air into the fresh air. Thus, for example, lacquer particles entering into the room air in a lacquering hall can be displaced toward the floor of the hall with a high intensity for removal through the section outlets O.

Although the invention has been described with reference to specific example embodiments it will be appreciated that it is intended to cover all modifications and equivalents within the scope of the appended claims.

What we claim is:

1. A device for introducing a low turbulence displacement air flow into an enclosed space, comprising a housing having a first air inlet housing section (1*a*) enclosing an air distribution volume (2), air inlet means (3, 3*a*) leading into said first housing section (1*a*) for admitting fresh air into said air distribution volume (2), a second air outlet housing section (1*b*) operatively connected to said first housing section for feeding a fresh air flow into said enclosed space, first air passage means (4, 8) leading from said air distribution volume (2) in said first housing section (1*a*) into said second housing section (1*b*), second air passage means (11) leading out of said first housing section for forming an air flow skirt around an outer surface of said second housing section (1*b*), air flow control means (7, 9, 12) for controlling an air flow through said first and second air passage means (4, 8, 11), a core pipe (5) having open ends and a closed side wall concentrically arranged in said second housing section (1*b*), said first air passage means having a central air passage (4) concentrically aligned with an upper open end of said core pipe, said second housing section (1*b*) having a perforated side wall (15) surrounding said core pipe to form a ring space (5*a*), said first air passage means further having at least one radially outer air passage (8) leading into said ring space (5*a*), and means (6) for operating said air flow control means (7, 9, 12) to distribute volume proportions of fresh air from said air distribution volume (2) into said core pipe (5) into said ring space (5*a*), and around said perforated side wall in accordance with fresh air requirements.

2. The device of claim 1, wherein said first housing section (1*a*) has an inner diameter larger than an outer diameter of said second housing section (1*b*) so that said first housing section extends radially outwardly of said second housing section for forming said second air passage means substantially as a ring gap (11) between said first and second housing sections (1*a*, 1*b*).

3. The device of claim 1, wherein said central air passage (4) is circular and wherein said radially outer air passage (8) comprises a plurality of holes arranged along a circle around said central air passage (4).

4. The device of claim 1, wherein said central air passage is (4) is circular and wherein said radially outer air passage (8) is a ring gap around said central passage (4).

5. The device of claim 1, wherein said flow control means comprise a valve disk (7) for opening and closing said central air passage (4), a first ring member (9) for closing and opening said radially outer air passage (8), a second ring member (12) for opening and closing said second air passage means (11), and means operatively interconnecting said valve disk (7), said first ring member (9) and said second ring member (12) with said operating means (6) for operating said flow control means.

6. The device of claim 5, wherein said valve disk (7), said second ring member (12) and said operating means (6) are located in said first housing section, and wherein said first ring member (9) is located in said second housing section, whereby said valve disk closes while said second ring member opens and vice versa.

7. The device of claim 5, wherein said valve disk (7) and said second ring member (12) operate in unison for opening and closing said central air passage (4) and said second air passage means (11), and wherein said first ring member (9) closes said radially outer air passage (8) when said central air passage (4) and said second air passage means (11) are open and vice versa.

8. The device of claim 1, wherein said perforated side wall of said second housing section surrounding said ring space (5*a*) has a cylindrical portion (15), a conical or frustum portion (16) and a perforated bottom (17) forming a circular perforated closure for said ring space and for a lower end of said core pipe, said conical or frustum portion (16) interconnecting said cylindrical portion (15) to said perforated bottom (17), having a diameter smaller than said cylindrical portion (15), whereby said conical or frustum portion tapers radially inwardly and downwardly at a tapering angle ($\alpha$).

9. The device of claim 8, wherein said tapering angle ($\alpha$) relative to the horizontal is within the range of 20° to 60°.

10. The device of claim 8, wherein said tapering angle ($\alpha$) relative to the horizontal is within the range of 40° to 50°.

11. The device of claim 1, further comprising a perforated air distribution plate (13) in said first housing section (1*b*), said air distribution plate having a diameter larger than said air inlet means (3), and means (13*b*) securing said air distribution plate (13) to said first housing section (1*a*) with a spacing from and in parallel to a cross-sectional flow area of said air inlet means (3).

12. The device of claim 1, wherein said second housing section (1*b*) has an outer diameter D within the range of 1.0 to 2.0 meters, said first and second housing sections having a total height Ht within the range of 1.0 to 1.5 meters, excluding any axial overlap between said first and second housing sections forming an air guide for said air flow skirt.

13. The device of claim 12, wherein said core pipe (5) has an inner diameter d corresponding to 0.1 to 0.4 times said outer diameter D of said second housing section (1*b*).

14. The device of claim 12, wherein said perforated side wall of said second housing section has a cylindrical portion (15) having an axial height h within the range of 0.1 to 0.5 of said outer diameter D of said second housing section (1*b*).

15. The device of claim 14, wherein said axial height h is within the range of 0.15 to 0.25 of said outer diameter D.

16. The device of claim 12, wherein said second housing section (1*b*) has a perforated circular bottom plate (17), a perforated cylindrical portion (15) and a perforated frustum portion (16) connecting said bottom plate (17) to said cylindrical portion (15), said bottom plate (17) having a diameter D1 corresponding to 0.5 to 0.8 times said outer diameter of said outer diameter D of said second housing section (1*b*).

17. The device of claim 16, wherein said diameter of said bottom plate (17) is within the range of 0.6 to 0.7 times said outer diameter of said second housing section (1*b*).

18. The device of claim 12, wherein said first housing section (1*b*) has an inner diameter larger than an outer diameter of said second housing section (1*b*), so that said first housing section extends radially outwardly of said second housing section (1*b*) for forming an air passage ring gap between said first and second housing sections, said ring gap having a radial width S within the range of 0.01 to 0.05 times said outer diameter D of said second housing section (1*b*).

19. The device of claim 18, wherein said ring gap has a radial width S within the range of 0.02 to 0.04 times said outer diameter D of said second housing section (1*b*).

20. The device of claim 1, further comprising a perforated bottom plate for covering said ring space (5*a*) at a spacing below said first housing section (1*a*).

* * * * *